US006974337B2

(12) United States Patent
Belopolsky et al.

(10) Patent No.: US 6,974,337 B2
(45) Date of Patent: Dec. 13, 2005

(54) ELECTRICAL CONNECTOR AND CONTACT FOR USE THEREIN

(75) Inventors: Yakov Belopolsky, Harrisburg, PA (US); Richard Pon, Taoyuan (CN)

(73) Assignee: FCI Americas Technology, Inc., Reno, NV (US)

( * ) Notice: Subject to any disclaimer, the term of this patent is extended or adjusted under 35 U.S.C. 154(b) by 0 days.

(21) Appl. No.: 10/621,288

(22) Filed: Jul. 17, 2003

(65) Prior Publication Data

US 2004/0097141 A1 May 20, 2004

(Under 37 CFR 1.47)

Related U.S. Application Data

(60) Provisional application No. 60/399,637, filed on Jul. 30, 2002.

(51) Int. Cl.[7] ..... H01R 13/42
(52) U.S. Cl. ..... 439/82; 439/751
(58) Field of Search ..... 439/82, 751

(56) References Cited

U.S. PATENT DOCUMENTS

| | | | | | |
|---|---|---|---|---|---|
| 3,056,939 | A | | 10/1962 | Rayburn | 339/17 |
| 3,239,720 | A | | 3/1966 | Rayburn | 317/101 |
| 3,524,108 | A | | 8/1970 | English | 317/101 |
| 3,747,045 | A | | 7/1973 | Stross | 339/17 |
| 4,217,024 | A | * | 8/1980 | Aldridge et al. | 439/381 |
| 4,407,556 | A | | 10/1983 | Hoschett | 339/91 |
| 4,553,801 | A | | 11/1985 | Zajeski | 339/59 |
| 4,575,167 | A | * | 3/1986 | Minter | 439/83 |
| 4,676,579 | A | * | 6/1987 | Ting | 439/825 |
| 4,735,587 | A | | 4/1988 | Kirayoglu | 439/751 |
| 4,847,588 | A | | 7/1989 | Doutrich | 439/751 |
| 4,900,276 | A | | 2/1990 | Doutrich | 439/751 |
| 4,911,645 | A | * | 3/1990 | August et al. | 439/75 |
| 5,102,356 | A | | 4/1992 | Adams et al. | 439/751 |
| 5,106,310 | A | * | 4/1992 | Krajewski et al. | 439/75 |
| 5,122,075 | A | | 6/1992 | Kile | 439/329 |
| 5,199,907 | A | | 4/1993 | Jansen et al. | 439/751 |
| 4,847,588 | A | | 9/1994 | Doutrich | 439/751 |
| 5,498,174 | A | | 3/1996 | Speer et al. | 439/567 |
| 6,524,129 | B2 | * | 2/2003 | Cote et al. | 439/511 |

FOREIGN PATENT DOCUMENTS

| | | |
|---|---|---|
| DE | 1 816 073 | 12/1968 |
| DE | 1 916 410 | 3/1969 |
| DE | 19 16 410 | 10/1970 |
| DE | 27 42 716 | 9/1977 |
| FR | 2 221 829 | 3/1973 |
| JP | 56-72485 | 6/1981 |
| JP | 57-80087 | 5/1982 |
| JP | 57-82076 | 5/1982 |

OTHER PUBLICATIONS

Chrysler Drawing Nos. 4230736 and 4230737 dated Oct. 1982.
Symbex Drawings (3).
AMP–AMP MODU MTE Interconnection System , Catalog 85773, Issued Nov. 1985.
Stocko (21 page) Product Brouchure , 5 Documents and 2 Invoices.
JST Product Brochures for EH and PH Connectors (2).

* cited by examiner

*Primary Examiner*—Gary Paumen
(74) *Attorney, Agent, or Firm*—Woodcock Washburn LLP

(57) ABSTRACT

Electrical connectors and contacts for engaging printed circuit boards are disclosed. One preferred contact has a first contact leg, a second contact leg arranged in a substantially mirror relationship with the first contact leg, and a connecting member extending between and being integral with the first contact leg and the second contact leg. Each of the contact legs includes a mating portion for insertion into a circuit board through hole. The mating portions have an elastically deformable beam for imparting a normal force onto a wall of a circuit board through hole.

26 Claims, 7 Drawing Sheets

ELECTRICAL CONNECTOR AND CONTACT FOR USE THEREIN

RELATED APPLICATION

This application claims the benefit of U.S. Provisional Application No. 60/399,637 filed on Jul. 30, 2002.

FIELD OF THE INVENTION

The invention generally relates to electrical contacts and connectors. Preferred connectors are particularly useful for connecting multiple circuit boards together, and for providing electrical contact in high power applications.

BACKGROUND OF THE INVENTION

Electrical connectors include contacts for engaging printed circuit boards. The boards may employ holes into which contact mating portions or tails are inserted. Low insertion forces can be achieved by having larger hole dimensions relative to the dimensions of the contact tails. For a fixed arrangement, solder can be added to provide retention of the contact tails once inserted into the board holes. For a removable arrangement, solder may or may not be desirable. In the absence of solder (or a substantial amount of solder), the relative dimensions of contact tails and board holes can be such that a press fit is provided. While adequate retention is accomplished through a press fit, insertion forces may be comprised. Accordingly, there is room for improvement in the art.

SUMMARY OF THE INVENTION

The present invention is directed to electrical contacts. Preferred contacts have a contact leg that has a mating portion including features that provide good electrical contact, relatively low insertion force into a printed circuit board through hole, and adequate retention within the through hole. In at least some of the preferred embodiments, the contact leg includes two beams, a first beam for fine adjustment of contact forces and a second beam for contact and retention force.

In accordance with one preferred embodiment of the present invention, there has now been provided a contact for an electrical connector, the contact having a first contact leg, a second contact leg arranged in a substantially mirror relationship with the first contact leg, and a connecting member extending between and being integral with the first contact leg and the second contact leg. Each of the contact legs includes a mating portion for engagement with one of a pair of spaced apart circuit board through holes disposed in a single circuit board. The mating portion includes an elastically deformable beam for imparting a normal force onto a wall of a circuit board through hole upon engagement of the mating portion with a circuit board.

In accordance with another preferred embodiment of the present invention, there has now been provided a contact for an electrical connector, the contact having a first contact leg, a second contact leg spaced apart from the first contact leg, and a connecting member extending between the first contact leg and the second contact leg and being integral therewith. Each of the contact legs includes a mating portion for engaging one of a pair of circuit board through holes. The mating portion comprises at least one hinge that facilitates elastic deformation of the mating portion upon engagement of the mating portion with a wall of a circuit board through hole.

In accordance with yet another preferred embodiment of the present invention, there has now been provided a contact for an electrical connector, the contact having a mating portion for engagement with a circuit board through hole. The mating portion includes a beam having a shoulder region extending orthogonal to a longitudinal contact axial line for limiting insertion depth of the mating portion, a discrete engaging area for imparting a normal force onto a wall of a circuit board through hole, and a hinge formed in the shoulder region that facilitates elastic deformation of at least some of the mating portion upon engagement of the discrete engaging area with a wall of a circuit board through hole.

The present invention is also directed to electrical connectors. Preferred electrical connectors act as interface connectors for connecting circuit boards together while reducing inductance and increasing current carrying capacity. Preferred connector embodiments include an insulative housing having passages that are capable of accepting a plurality of contacts, including the preferred contact embodiments described above.

BRIEF DESCRIPTION OF THE DRAWINGS

The foregoing summary, as well as the following detailed description of preferred embodiments, is better understood when read in conjunction with the appended drawings. For the purpose of illustrating the invention, there is shown in the drawings exemplary constructions of the invention; however, the invention is not limited to the specific features disclosed. In the drawings.

DETAILED DESCRIPTION OF PREFERRED EMBODIMENTS

Interface connectors for connecting multiple circuit boards together are provided. A typical circuit substrate such as a microprocessor board can include traces or pads for, for example, cache, power, and return traces. It is desirable to connect the circuit board to another circuit substrate such as a power board. Typically, the cache, the power, and the return traces connect to suitable conductive elements on the power board. It is desirable to reduce the inductance between the interconnection of the boards, while at the same time, increase the current carrying capacity. It is understood that the arrangement of cache, power, and return traces could be varied as desired by the circuit board designer.

Figure 1:
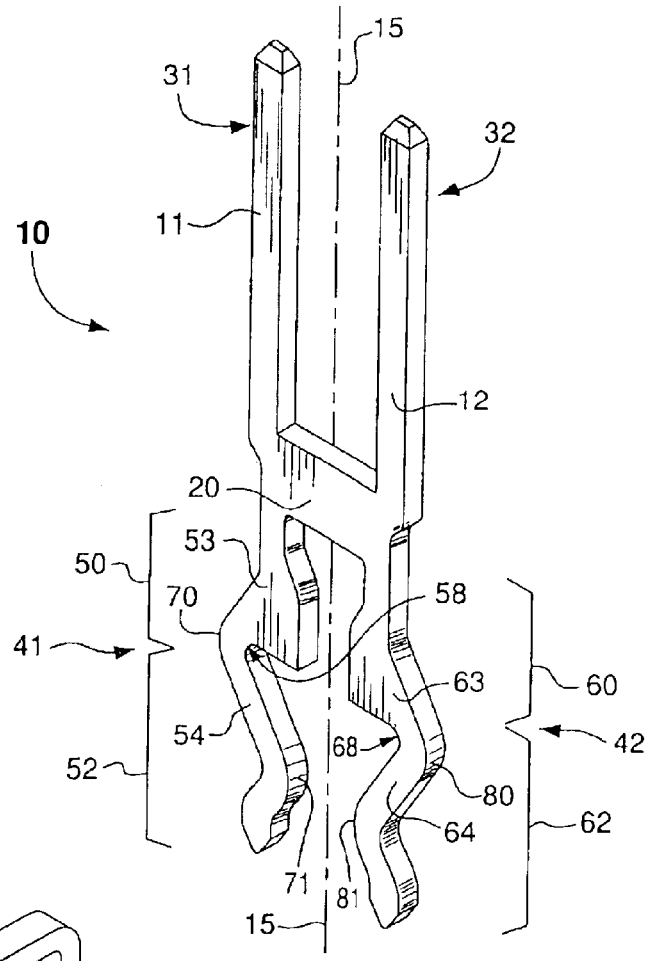
FIG. 1 is a perspective view of an exemplary contact having opposing mating portions for connecting a pair of circuit boards, one of the mating portions has a hinge to facilitate elastic deformation of the same.
Figure 2:
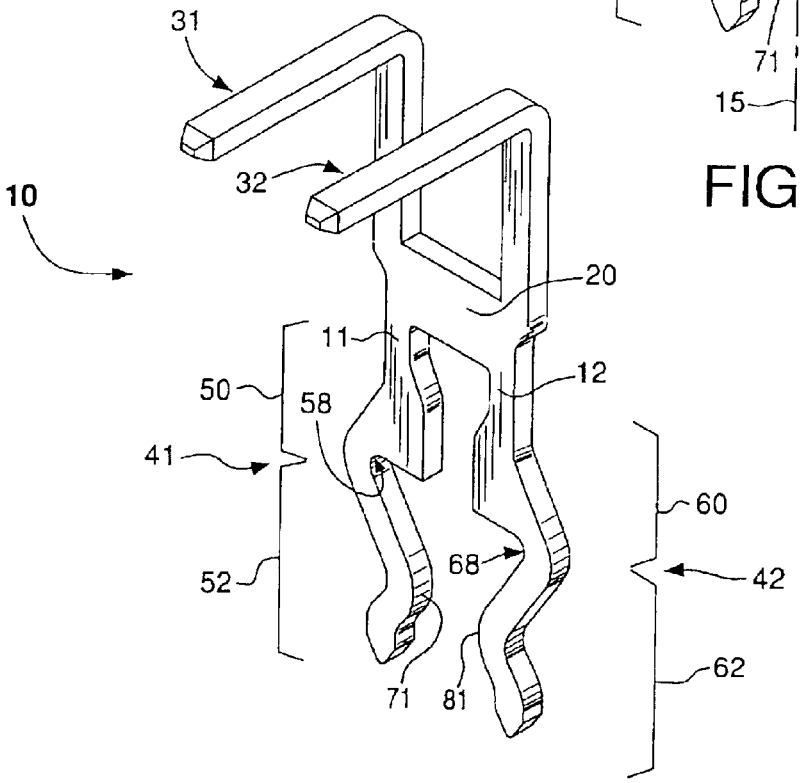
FIG. 2 is a perspective view of a similar contact to that shown in FIG. 1, with one of the opposing mating portions being angled.

The present invention is believed to be best understood through the following detailed description of preferred embodiments and the accompanying drawings wherein like reference numbers indicate like features. Referring to FIGS. 1 and 2, an exemplary contact 10 is shown comprising a pair of contact legs 11 and 12, preferably in mirror relationship with each other, although this is not a requirement. A connecting member 20 couples contact leg 11 to contact leg 12. Contact leg 11, contact leg 12 and connecting member 20 are preferably integral components (i.e., formed together as a single unit). The preferred integral configuration of contacts legs 11, 12 and connecting member 20 facilitates good electrical connection and high power application.

Each of the contact legs 11, 12 has opposing mating portions 31, 32 and 41, 42, respectively, for engagement with a printed circuit board, either removably or fixed (e.g., with solder). Mating portions 31, 32 can both engage a board on the same side of the board, or on opposite sides of the board. Similarly, mating portions 41, 42 can both engage a board on the same side of the board, or on opposite sides of the board. As shown in the figures, mating portions 31 and 32 (and 41 and 42) are preferably substantially parallel to each other, though this is not a requirement. It is to be understood that the present invention contemplates leg to leg variations encompassed within the mating portions although not illustrated in the figures herein.

Mating portions 31, 32 are preferably configured for a soldered connection to a circuit board, whereas mating portions 41, 42 are preferably configured for a solder-free connection (although some solder may be utilized with mating portions 41, 42). Alternative embodiments (not shown) include opposing mating portions that are both configured for a solder-free connection to a circuit board, such as through employment of opposing mating portions similarly designed to that of mating portions 41, 42. It is contemplated that the mating portions can be either straight, angled, or have any other suitable arrangement, depending on the circuit boards the connector is to interconnect. By way of example, mating portions 31, 32 have a straight orientation in FIG. 1, and are angled substantially at 90 degrees in FIG. 2.

Referring now to FIG. 1, engagement portions 41, 42 are preferably configured for a solder-free connection to permit engagement and disengagement with a circuit board as desired. Mating portions 41, 42 include features that provide a relatively low insertion force into a circuit board through hole, while maintaining sufficient retention therein. As described in more detail below, the balance of low insertion force and sufficient retention is preferably provided through one or more elastically deformable beams, and one or more hinges that facilitate elastic deformation and/or deflection of at least some of mating portions 41, 42 upon insertion into a circuit board through hole. The elastic deformation results in mating portion 41, 42 imparting a normal or retentive force on a through hole sidewall. "Elastic deformation" as used herein means substantially non-plastic or non-permanent deformation (that is, the contact should return to its original geometry when disengaged from a circuit board through hole—although, a minor amount of plastic deformation is allowed). "Hinge" as used herein includes, but is not limited to, bends, arches, indentations, scores, weakened areas, relieved areas and the like.

Contact legs 11 and 12 each include at least two beams, with at least a portion of each of the two beams residing in mating portions 41 and 42, respectively. Employing two beams can provide good electrical contact in high power applications, and can provide adjustment ("tuning") of contact and retentive forces. Contact leg 11 has a first beam 50 and a second beam 52 extending therefrom. In a preferred embodiment, first beam 50 includes an angled section 53 that is angled outwardly and away from a longitudinal contact axial line 15, and second beam 52 includes an angled section 54 that is angled inwardly and toward axial line 15. Angled sections 53 and 54 help to define discrete engaging areas 70 and 71 for contacting a wall of a circuit board through hole. Discrete engaging areas can help minimize insertion force through reduced friction when mating portion 41 is inserted into circuit board through hole. Similarly, contact leg 12 has a first beam 60 and a second beam 62. First beam 60 includes angled section 63, while second beam 62 includes angled section 64. Mating portion 42 is shown having discrete engaging areas 80 and 81. It is to be understood, that mating portions 41 and 42 each may include more than two beams, and may include a single discrete engaging area or more than two discrete engaging areas.

Mating portions 41, 42 preferably include one or more hinges to facilitate elastic deformation or deflection of at least some of the mating portions upon insertion into a circuit board through hole. Exemplary contact 10, shown in FIGS. 1 and 2, employs a single hinge in each of the mating portions 41 and 42. Mating portion 41 has a hinge 58 disposed proximate the intersection of beams 50 and 52, while mating portion 42 has a hinge 68 disposed proximate the intersection of beams 60 and 62.

Figure 3A:
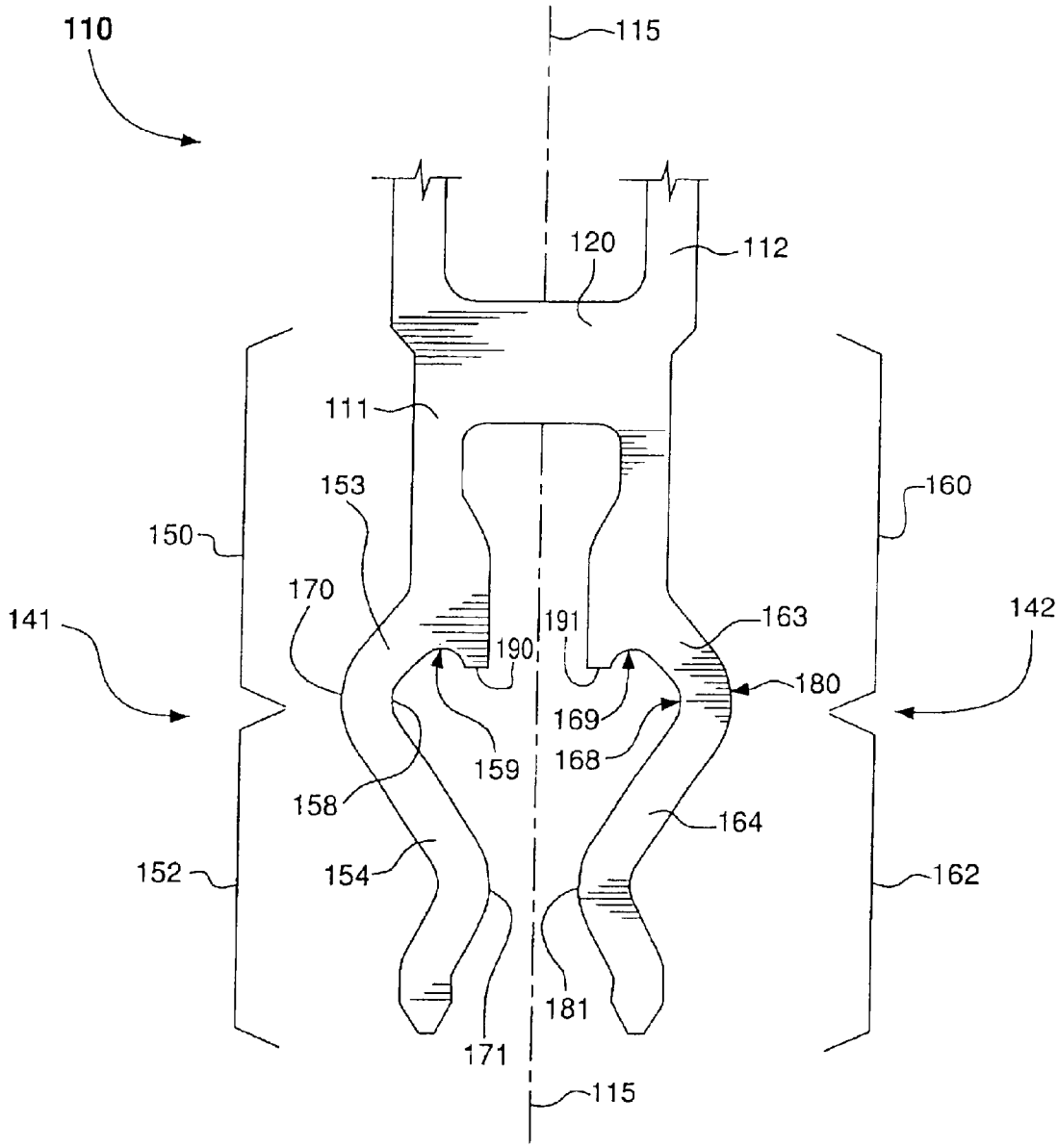
FIG. 3A is a partial front view of another exemplary contact including a mating portion having two hinges to facilitate elastic deformation of at least some of the mating portion upon insertion into circuit board through holes.

Another exemplary contact 110 is shown in FIG. 3A. Contact 110 includes similar features to that of contact 10, with the similar features being labeled with the same reference characters in the hundred series. Each of the mating portions 141 and 142 of contact 110 employs two hinges to facilitate elastic deformation or deflection. By way of example, mating portion 141 (142) has a first hinge 158 (168) disposed proximate the intersection of first beam 150 (160) and second beam 152 (162), and a second hinge 159 (169) disposed in a shoulder region 190 (191) that limits an insertion depth of the contact into a circuit board through hole. Preferably, each of hinges 158 and 159 facilitate elastic deformation or lateral deflection of at least some of mating portion 141 upon insertion into a circuit board through hole. Hinges 158 (168) and 159 (169) may facilitate elastic deformation or lateral deflection of mating portion 141 (142) in a single direction. The two hinges may, alternatively, facilitate elastic deformation or lateral deflection in opposing directions. That is, one region of mating portion 141 (142) may deflect inwardly toward contact axial line 115 via one of the hinges, and another region of mating portion 141 (142) may deflect outwardly and away from contact axial line 115 via the other hinge.

Figure 3B:
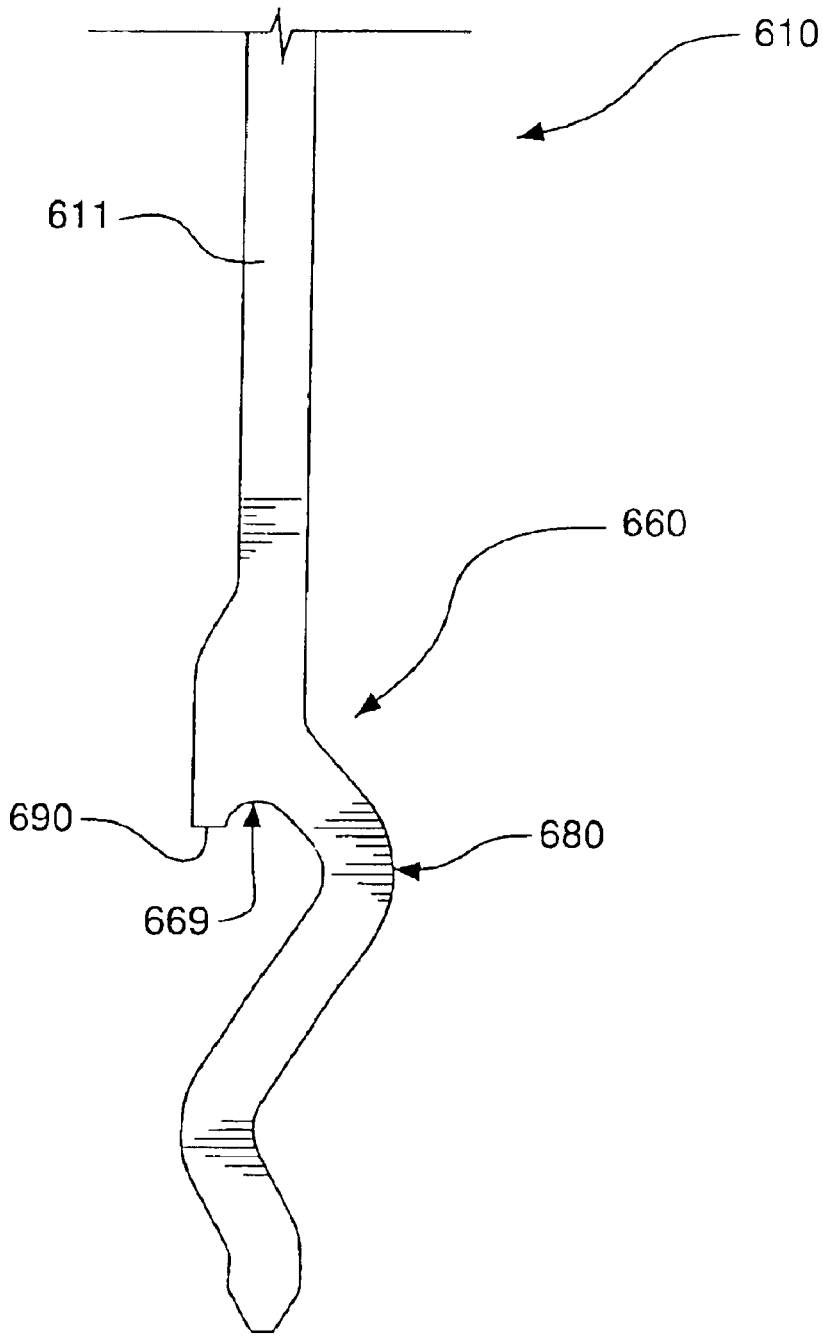
FIG. 3B is a partial front view of an alternative contact embodiment to the contact shown in FIG. 3A, wherein the alternative contact embodiment includes only a single contact leg.

Alternative contacts contemplated by the present invention have only a single contact leg. By way of example and with reference to FIG. 3B, contact 610 is illustrated, which contains similar features to those of contact 110 shown in FIG. 3A, but instead of having two contact legs, has a single contact leg 611. Contact leg 611 includes a beam 660 having a shoulder region 690, a discrete engaging area 680, and a hinge 669 formed in shoulder region 690 that facilitates elastic deformation and/or deflection of beam 660 upon the discrete engaging area 680 contacting a wall of a circuit board through hole.

The hinges and discrete engaging areas can (independently or collectively) provide a balance of low insertion force and adequate retention in a circuit board through hole. The hinges and discrete engaging areas can help minimize insertion forces. Elastic deformation or deflection of the mating portions, via the hinges, can also help retention because the deformation or deflection results in beam engaging areas imparting a normal force or retentive force on a circuit board through hole sidewall.

Figure 4:
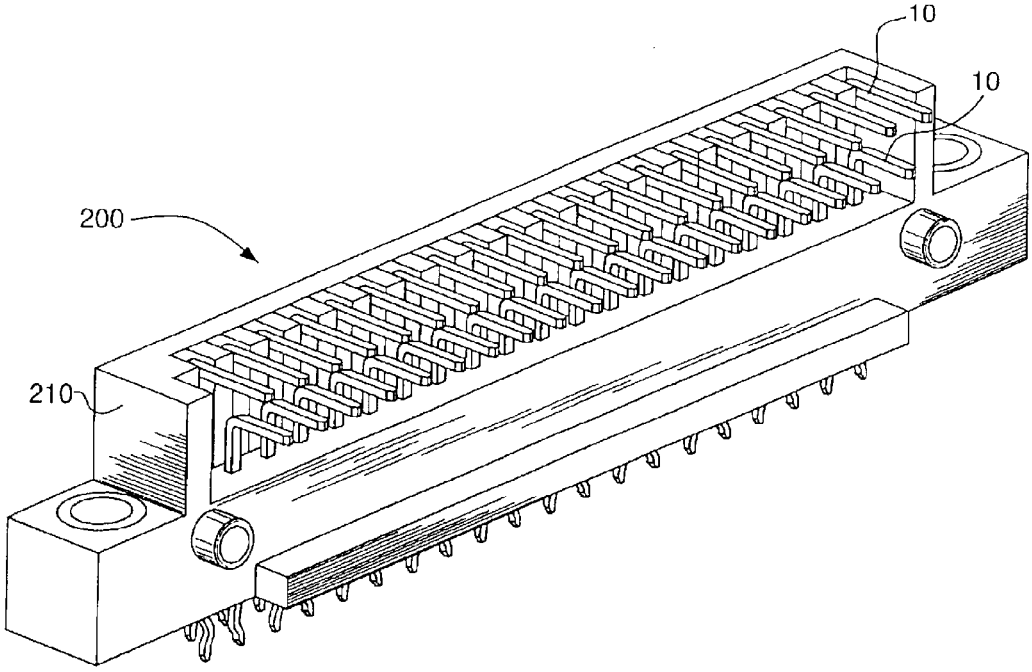
FIG. 4 is a perspective view of a preferred electrical connector having a plurality of contacts arranged in an insulative housing.
Figure 5:
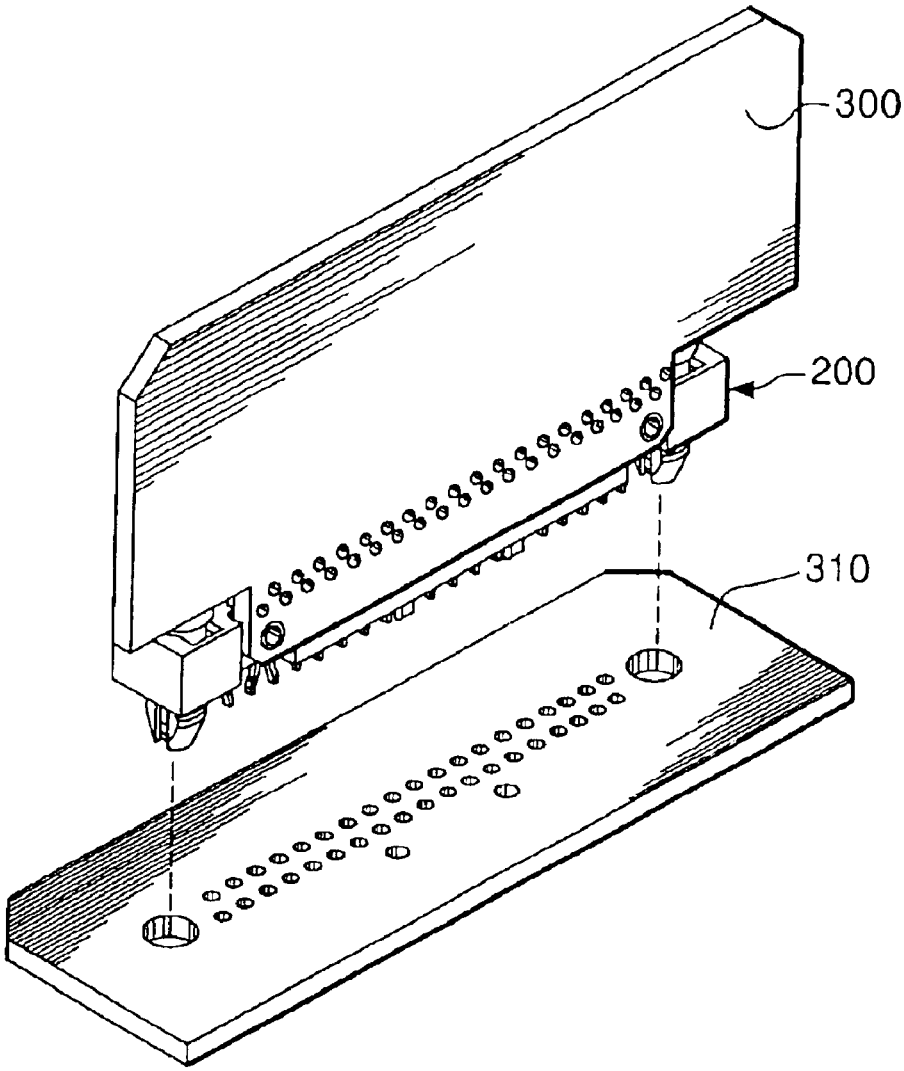
FIG. 5 is a perspective view of the electrical connector of FIG. 4 connected to a first circuit board and disengaged from and arranged above a second circuit board.
Figure 6A:
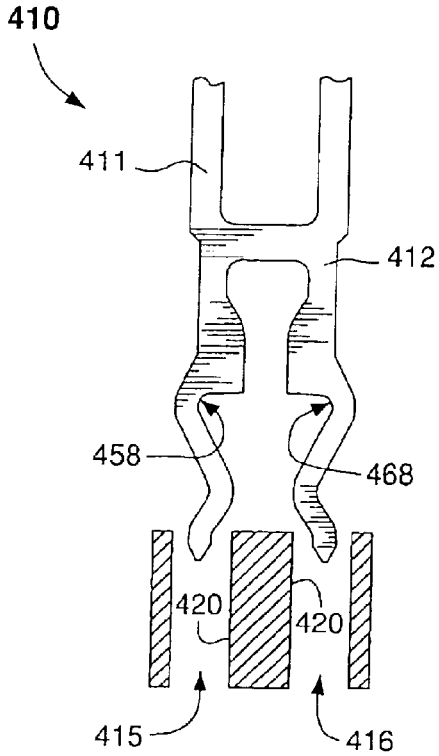
FIGS. 6A–6C is a series of partial cross-sectional views of a preferred contact being inserted into circuit board through holes.
Figure 6B:
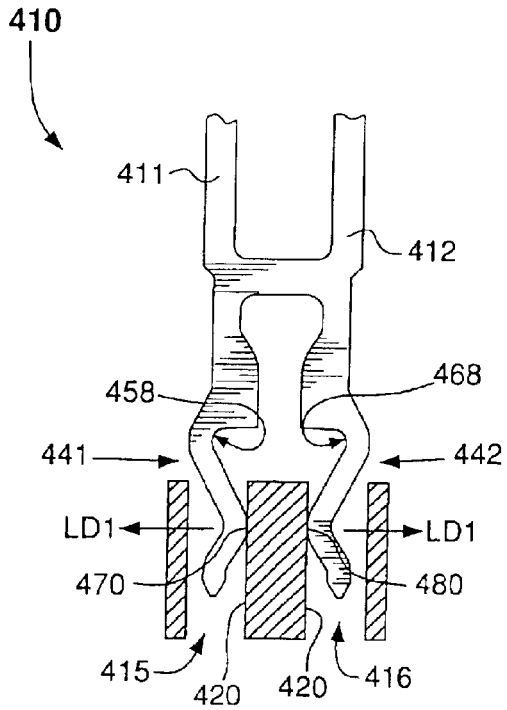
Figure 6C:
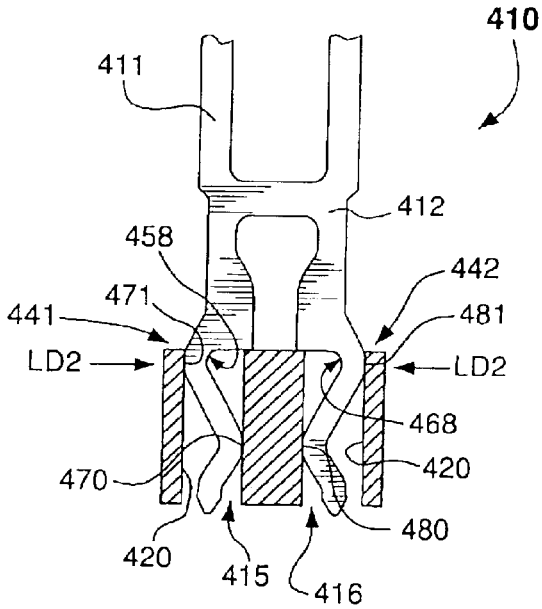

Referring now to FIGS. 4 and 5, an electrical connector 200 for connecting multiple circuit boards together is shown. Electrical connector 200 includes an insulative housing 210 having a plurality of contacts, such as, for example, preferred contacts 10 or 110, disposed therein. The plurality of contacts may be similar or dissimilar to each other. As can be seen in FIG. 5, connector 200 is engaged with a first circuit board 300 and disengaged from a second circuit board 310. The circuit boards 300 and 310 will be connected by connector 200 in an orthogonal configuration; however, a parallel interconnection is also contemplated by the present invention by employing contacts with straight mating portions on both ends thereof. In a preferred embodiment, the contacts disposed in connector 200 include mating portions configured for a soldered connection to board 300 and opposing mating portions configured for a solder-free (press-fit) connection to board 310. Alternatively, both mating portions may be configured for a solder-free connection to a respective circuit board.

Exemplary dynamics or interaction of contact mating portions with circuit board through holes will be discussed with reference to FIGS. 6A–6C and 7A–7C. Referring first to the partial cross-sectional views of FIGS. 6A–6C, an exemplary contact 410 having a first contact leg 411 and an second contact leg 412 is shown. Each of the contact legs 411 and 412 has a first discrete engaging area 470 and 480, respectively, that engages a wall 420 of circuit board through holes 415, 416 upon partial insertion of contact 410. When the first discrete engaging areas 470, 480 engages a region of wall 420, mating portions 441, 442 elastically deform or deflect in a direction LD1. Elastic deformation or deflection is facilitated by employment of hinges 458, 468. Upon further insertion of contact 410 into through holes 415, 416, second discrete engaging area 471, 481 engage an opposing region of wall 420 such that mating portions 441, 442 deform or deflect in a direction LD2 via hinge 458, 468.

Figure 7A:
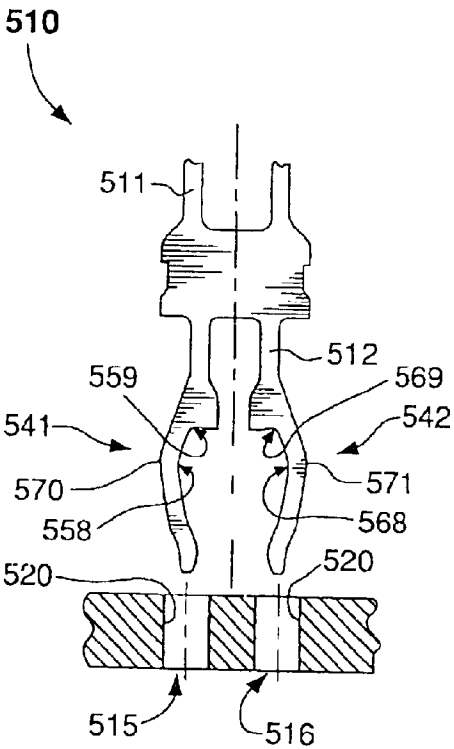
FIGS. 7A–7C is a series of partial cross-sectional views of another preferred contact being inserted into circuit board through holes.
Figure 7B:
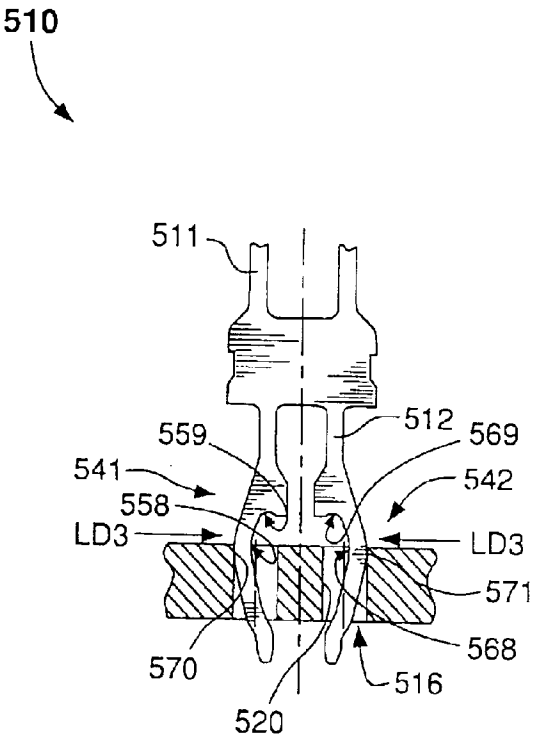
Figure 7C:
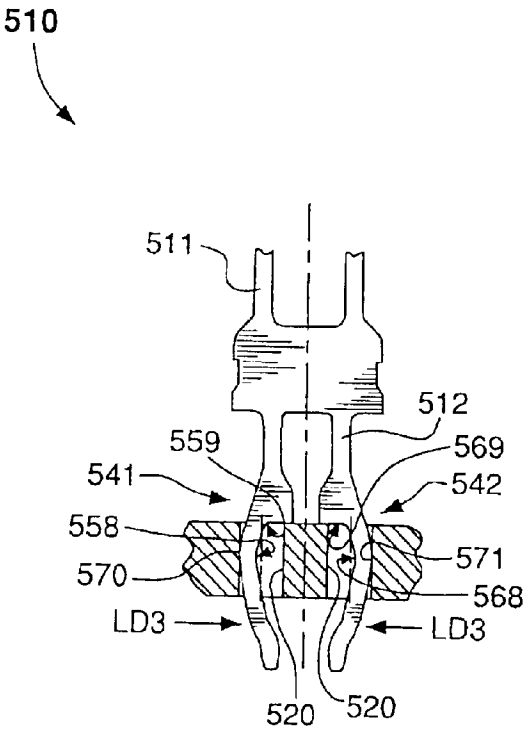

Referring to FIGS. 7A–7C, another exemplary contact 510 is configured to include a pair of contact legs 511 and 512, with each of the contact legs including a mating portion 541 and 542, respectively. Each of mating portions 541, 542 includes two hinges 558, 568 and 559, 569, respectively, and a single discrete engaging area 570, 571, respectively, for engaging wall 520 of circuit board through hole 515, 516. Hinges 558, 559, 568 and 569 preferably facilitate respective elastic deformation or deflection in a direction LD3. The dynamics described with reference to FIGS. 6A–6C and 7A–7C are illustrative only, and are not limiting. That is, the dynamics can vary depending on the configuration of alternative contact embodiments and the configuration of circuit though holes to be engaged.

Preferred contacts of the present invention may be stamped or otherwise formed from materials known by those of ordinary skill in the art. Suitable contact materials includes, but is not limited to, phosphor bronze alloys, beryllium copper alloys and high conductivity copper alloys. The contacts may be plated with known materials as well, including gold, or a combination of gold and nickel. The insulative housing of preferred connectors of the present invention may be molded or formed from a glass-filled high temperature nylon or other materials known to one having ordinary skill in the art. The contacts can be inserted into passages of the housing after it is molded, or the housing may be formed around an array of contacts.

It is to be understood that even though numerous characteristics and advantages of the present invention have been set forth in the foregoing description, together with details of the structure and function of the invention, the disclosure is illustrative only. Accordingly, changes may be made in detail, especially in matters of shape, size and arrangement of features within the principles of the invention to the full extent indicated by the broad general meaning of the terms in which the appended claims are expressed.

What is claimed is:

1. A contact for an electrical connector, the contact comprising:

a) a first contact leg;

b) a second contact leg arranged in a substantially mirror relationship with the first contact leg; and c) a connecting member extending between and being integral with the first contact leg and the second contact leg;

wherein each of the first contact leg and the second contact leg includes a mating portion for engagement with one of a pair of spaced apart circuit board through holes disposed in a single circuit board, the mating portion comprising an elastically deformable beam for imparting a normal force onto a wall of a circuit board through hole upon engagement of the mating portion with a circuit board, and wherein the elastically deformable beam includes a shoulder region for limiting insertion depth of the mating portion into a circuit board through hole.

2. The contact of claim 1, wherein the elastically deformable beam includes a hinge that facilitates elastic deformation of the elastically deformable beam.

3. The contact of claim 1, wherein a hinge is formed in the shoulder region.

4. The contact of claim 1, wherein the mating portion further comprises a second beam extending from the elastically deformable beam.

5. The contact of claim 4, wherein an intersection of the elastically deformable beam and the second beam defines a discrete engaging area such that friction between the contact mating portion and a circuit board through hole is minimized.

6. The contact of claim 5, wherein the second beam includes a second discrete engaging area that is transversely offset from the discrete engaging area.

7. The contact of claim 1, wherein the mating portion includes first and second discrete engaging areas for engaging a wall of a circuit board through hole.

8. The contact of claim 7, wherein the first discrete engaging area is vertically and transversely offset from the second discrete engaging area.

9. An electrical connector comprising:

an insulative housing; and a contact according to claim 1 disposed in the insulative housing.

10. A contact for an electrical connector, the contact comprising:

a) a first contact leg;

b) a second contact leg arranged in a substantially mirror relationship with the first contact leg; and c) a connecting member extending between and being integral with the-first contact leg and the second contact leg;

wherein each of the first contact leg and the second contact leg includes a mating portion for engagement with one of a pair of spaced apart circuit board through holes disposed in a single circuit board, the mating portion comprising an elastically deformable beam for imparting a normal force onto a wall of a circuit board through hole upon engagement of the mating portion with a circuit board, and wherein each of the first contact leg and the second contact leg includes a second mating portion distally located from the mating portion for a soldered connection with a second circuit board.

11. An electrical connector comprising:

an insulative housing; and a contact according to claim 10 disposed in the insulative housing.

12. The contact of claim 10, wherein the mating portion is parallel with the second mating portion.

13. The contact of claim 10, wherein the mating portion is orthogonally arranged with respect to the second mating portion.

14. The contact of claim 10, wherein the mating portion comprises at least one hinge that facilitates elastic deformation of the mating portion upon engagement of the mating portion with a wall of a circuit board through hole.

15. The contact of claim 10, wherein the mating portion comprises two hinges that facilitate elastic deformation of the mating portion upon engagement of the mating portion with a wall of a circuit board through hole.

16. A contact for an electrical connector, the contact comprising:

a) a first contact leg;

b) a second contact leg spaced apart from the first contact leg;

c) a connecting member extending between the first contact leg and the second contact leg and being integral therewith; wherein each of the first contact leg and the second contact leg includes a mating portion for engaging one of a pair of circuit board through holes formed in a single circuit board, the mating portion comprising at least one hinge that facilitates elastic deformation of the mating portion upon engagement of the mating portion with a wall of a circuit board through hole, and wherein the mating portion consists of a first discrete engaging area defined by a first bend and a second discrete engaging area defined by a second bend for engaging a wall of a circuit board through hole.

17. The contact of claim 16, wherein the first beam includes a shoulder oriented orthogonal to the longitudinal contact axial line for limiting insertion depth of the mating portion into a circuit board through hole.

18. The contact of claim 17, wherein the at least one hinge is disposed in the shoulder.

19. The contact of claim 16, wherein the first discrete engaging area is both vertically and transversely offset from the second discrete engaging area.

20. An electrical connector comprising:

an insulative housing; and a contact according to claim 16 disposed in the insulative housing.

21. A contact for an electrical connector, the contact comprising:

a contact leg including a mating portion for engagement with a circuit board through hole, the mating portion including a beam comprising:

a) a shoulder region extending orthogonal to a longitudinal contact axial line for limiting insertion depth of the mating portion into a circuit board through hole;

b) a discrete engaging area for imparting a normal force onto a wall of a circuit board through hole; and c) a hinge formed in the shoulder region that facilitates elastic deformation of at least some of the mating portion upon engagement of the discrete engaging area with a wall of a circuit board through hole.

22. The contact of claim 21, further comprising a second contact leg that is arranged in a substantially minor relationship with the contact leg, and a connecting member coupling the second contact leg to the contact leg.

23. The contact of claim 22, wherein the contact leg, the second contact leg, and the connecting member are integral.

24. The contact of claim 22, wherein the second contact leg has a mating portion that is configured similar to that of the contact leg.

25. The contact of claim 24, wherein the mating portion of each of the contact leg and the second contact leg further comprises a second discrete engaging area that is laterally and vertically offset from the discrete engaging area.

26. An electrical connector comprising:

an insulative housing; and a contact according to claim 21 disposed in the insulative housing.

* * * * *